US007786854B2

(12) United States Patent
Hosey

(10) Patent No.: US 7,786,854 B2
(45) Date of Patent: Aug. 31, 2010

(54) ALARM SYSTEM WALK TEST

(75) Inventor: Mark Hosey, East Kilbride (GB)

(73) Assignee: Honeywell International Inc., Morristown, NJ (US)

( * ) Notice: Subject to any disclaimer, the term of this patent is extended or adjusted under 35 U.S.C. 154(b) by 409 days.

(21) Appl. No.: 12/015,679

(22) Filed: Jan. 17, 2008

(65) Prior Publication Data

US 2009/0184816 A1 Jul. 23, 2009

(51) Int. Cl.
*G08B 29/00* (2006.01)

(52) U.S. Cl. ..... 340/514

(58) Field of Classification Search ..... 340/514, 340/506, 515, 522, 517, 628
See application file for complete search history.

(56) References Cited

U.S. PATENT DOCUMENTS 4,725,818 A * 2/1988 Motyka et al. ..... 340/514
2004/0090327 A1* 5/2004 Soloway et al. ..... 340/545.1
2008/0122575 A1* 5/2008 Lavian et al. ..... 340/3.1

* cited by examiner

*Primary Examiner*—Phung Nguyen
(74) *Attorney, Agent, or Firm*—Husch Blackwell Sanders Welsh & Katz

(57) ABSTRACT

A system and method for performing a walk test for an alarm system having an alarm panel and at least one zone, each zone having at least one sensor, having steps of placing the alarm panel in an engineering mode, establishing a communications channel between the alarm panel and a communication device and remotely placing the alarm panel in an appropriate state for each walk test, selecting a zone, triggering an alarm for each sensor in the selected zone, and using the communications channel to report the triggered alarm to the communication device, and remotely placing the alarm panel in an appropriate state for the next walk test after triggering all of the sensors in the zone. The system and method can also include user input to the alarm panel to indicate the desired communications channel.

18 Claims, 2 Drawing Sheets

ALARM SYSTEM WALK TEST

FIELD OF THE INVENTION

This invention relates generally to alarm systems. In particular, this invention relates to performing a walk test of an alarm system.

BACKGROUND OF THE INVENTION

Alarm systems employed to monitor domestic and business properties are used to detect unauthorized intrusion, fire, smoke or the presence of dangerous materials or gasses. Traditionally, an alarm system comprises a control or alarm panel with one or more display devices such as an LCD keypad, sensors such as motion detectors, heat detectors, etc., and actuators such as bells, sounders, flashing lights, etc., all of which are associated with the control panel and mounted throughout the protected premises. Alarm panels receive status information of the sensors and actuators present on the alarm system. In response to changes in status, the panel will activate appropriate actuators and will transmit alarm system status and changes in status externally to alarm reporting stations. The transmission of alarm status information may be done in a variety of ways, such as via telephone technology, e.g., plain old telephone systems (POTS), global system for mobile communications (GSM), and general packet radio service (GPRS), or via Ethernet with WIFI link or radio frequency (RF), among others.

When an alarm system is armed, it is placed in a mode that will allow it to detect and report alarm related events, such as an intrusion in an intruder alarm system, fire and/or smoke in a fire alarm system, etc. The sensor(s) detecting the alarm event reports it to the control panel. The control panel then responds by activating alarm indication actuators, e.g. it may enable a bell, flashing lights, etc., and will report the alarm status to an alarm monitoring station. When installing alarm systems, each individual sensor and actuator must be tested to ensure not only that it is functioning correctly and to the appropriate alarm standards, but also that it is correctly wired to the control panel. This testing or fault finding of the individual sensors is generally done in a "walk test".

Walk testing alarm systems normally requires two engineers, one to trigger alarms and observe indications by walking through the building stimulating the various sensors, the other to monitor, for each resulting alarm condition, the alarm panel's display device that corresponds to the stimulated sensors. Every time an alarm response is triggered, it is documented and the alarm system is then placed in an appropriate state for walk testing the next area to be tested.

Walk testing can be done by one engineer but it is time consuming, especially for large installations. The walk test requires the lone engineer to trigger alarms by walking through the protected area, stimulating or triggering sensors. This engineer must then return to the control panel periodically to interrogate the alarm system log and place the alarm panel in an appropriate state before continuing with the next part of the walk test.

Among the problems of the aforementioned approach is the need for a physical presence of an installer at the control panel during the walk test. Hence, either two installers are required for the walk test, or one installer must travel back and forth between the sensors throughout the protected area and the control panel, necessitating the use of significant resources to complete and validate installation of the security system.

SUMMARY OF THE INVENTION

The present invention advantageously enables a single installer, test engineer, or installation engineer to carry out an alarm system walk test efficiently without assistance. Using the inventive remote walk testing system for alarm systems removes the need for the engineer to periodically return to the control panel's display and input device, such as at the conclusion of testing of each zone of a walk test, to observe the result and prepare the system for walk testing the next zone or section of the protected site.

The inventive system and method for performing a walk test for an alarm system having an alarm panel and at least one zone, each zone having at least one sensor, has steps of operating the alarm panel in an engineering mode, establishing a communications channel between the alarm panel and a communication device, initiating limited remote control of the alarm panel with the communication device providing the means of remote control, control remotely the walk test functionality of the alarm panel, remotely set the alarm panel in an appropriate state for the walk test, selecting a zone, triggering an alarm for each sensor in the selected zone, and using the communications channel to report the triggering of the alarm to the communication device, that is, to remotely observe alarm system status and in particular any and all indications resulting from the triggered sensor, and to remotely prepare the alarm panel for subsequent walk tests by placing the alarm panel in the appropriate state for the walk test of a next zone after triggering sensors in the selected zone. For security purposes, the facilities offered by the inventive system and method to the installation engineer must not be available without operating engineering mode of operation of the alarm panel. The engineering mode can have a walk test mode. The communications channel can be selected by the engineer, and the communication device can be the engineer's preferred communication device.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings. As should be understood, however, the invention is not limited to the precise arrangements and instrumentalities shown. In the drawings.

DETAILED DESCRIPTION OF THE INVENTION

Figure 1:
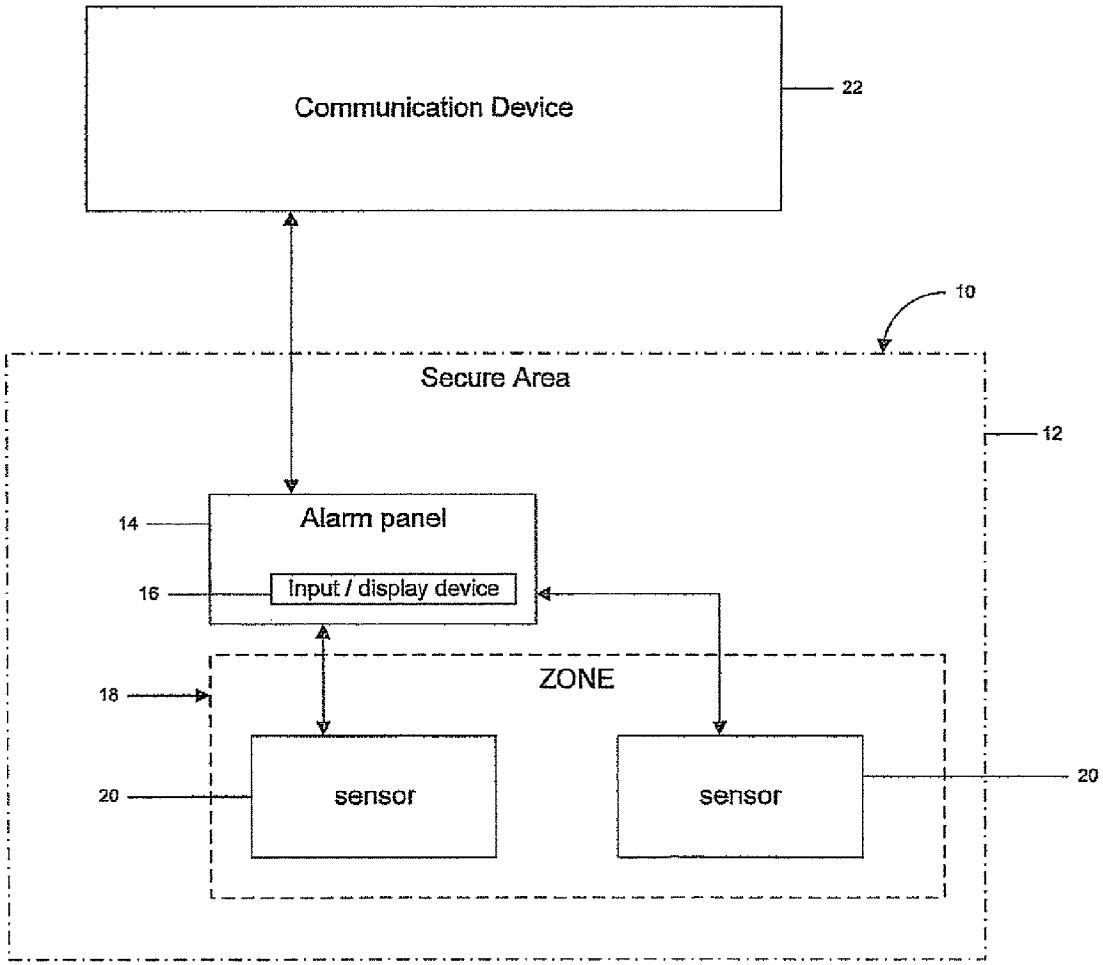
FIG. 1 is a block diagram of an embodiment of the present invention.

An inventive solution is presented to the need for an efficient, time saving system and method for performing a walk test for an alarm system. FIG. 1 illustrates a security alarm system or security system 10 having a secured area or protected site 12 that can include a control or alarm panel 14 having a display and input device, for example a keypad with LCD display 16. In an alternative embodiment for alarm systems other than security alarm systems, the alarm panel 14 can reside outside the secured area 12. The security alarm system 10 shown in FIG. 1 has only one zone 18 having two sensors 20, but any number of zones 18 having any number of sensors 20 can be included in the security system 10. For example, a large protected site can include twenty-five or more zones 18.

A communication device 22 communicates with the control panel 14 of the security system 10. Methods of communication can include the variety of methods, discussed above, used by alarm panels 14 to transmit alarm information, such as via telephone, via Ethernet, etc. Communication devices 22 can include mobile telephones, hand held computers, personal digital assistants (PDA), or portable personal computers (PC). Any communication method and/or communication device 22 known to those skilled in the art can be used in accordance with the scope of this invention. All walk test results are reported to the active reporting device 22 by a method it determines. For instance, a portable PC would perhaps use hyper-terminal (known in the art as a standard piece of software on a PC) to display results and transmit commands. Regardless of the reporting device 22, the presentation of report information to the engineer is a design choice for those skilled in the art.

The inventive apparatus, which can be implemented solely in software, provides the installation engineer with the means to monitor the alarm panel 14 remotely by reporting alarm panel status to the engineer's communication device 22. The inventive solution must also provide the engineer with limited remote control of the alarm panel 14, sufficient for carrying out walk tests and carrying out remedial action in the event of a walk test fail. However, this inventive apparatus must only be enabled when the alarm panel 14 is in engineering mode.

Figure 2:
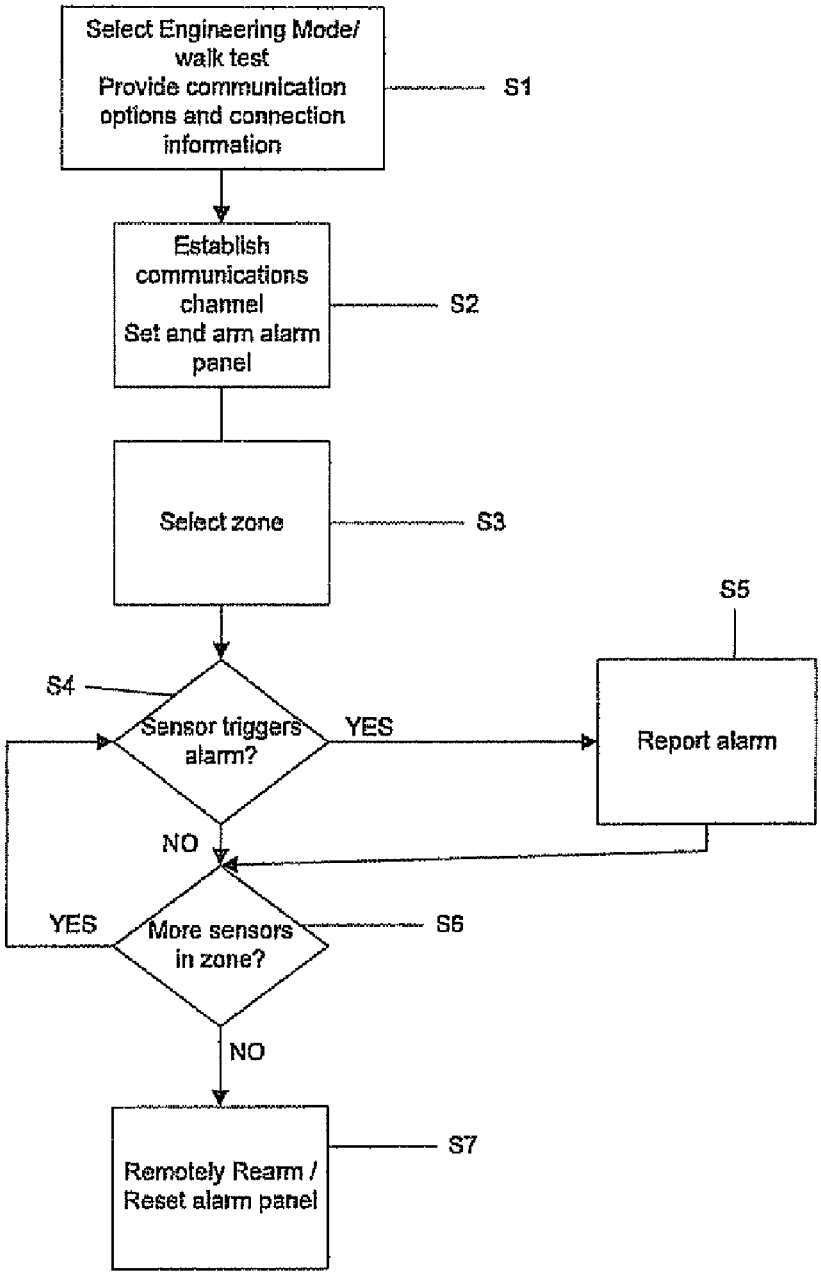
FIG. 2 is a flow diagram of an embodiment of the present invention.

Operation of the inventive apparatus is shown in FIG. 2, in accordance with the system shown in FIG. 1. When an engineer performs a walk test of a system, in step S1, he must select "walk test" from the appropriate menu presented to him on one of the alarm system's display and input devices 16. The engineer will be asked to provide a communication option and connection information as well as any other additional necessary information associated with the communication or reporting option selected by the engineer. For example, if the engineer has elected to use his mobile telephone as the communication device 22, the apparatus must request the telephone number, while for ethernet, WIFI or Bluetooth communication, the ethernet, WIFI or Bluetooth address of the communication device 22 is requested.

A communications channel is established with the selected reporting device 22 in step S2, and the engineer remotely sets the system in an appropriate state for each walk test 14, by issuing the appropriate commands from the reporting device 22. In step S3, the engineer nominates or selects the sensor(s) 20 and/or zone(s) 18 to be walk tested, and the testing of the individual sensor(s) 20 within a zone 18 commences.

A sensor 20 within the selected zone 18 is tested in step S4. If the sensor 20 or zone 18 triggers an alarm condition (S4=YES), it is reported to the engineer via his communication device 22 in step S5. If no alarm condition is triggered (S4=NO), or after the condition is reported in step S5, the inventive apparatus determines whether additional sensors 20 remain to be tested in step S6. If so (S6=YES), the testing continues in step S4. If not (S6=NO), testing of the selected zone 18 is complete. In step S7, the engineer remotely sets the alarm system 10 into the appropriate state for the next walk test.

Failure to trigger an alarm (S4=NO) indicates a fault to be investigated. On exiting the walk test mode or engineering mode, the inventive apparatus must disconnect from the reporting device 22 and erase all data relating to the connection, i.e. telephone numbers, addresses, etc.

Using a remote walk testing system for alarm systems 10 removes the need for the engineer to return to the alarm panel's display and input device 16 at the conclusion of each walk test to prepare the system for walk testing the next zone 18 on the protected site 12. On a large site with twenty-five or more zones 20, this test method would save the engineer all the time required to walk to the test zone and back to the alarm panel's display and input device 16 up to twenty-five times.

The embodiments described above are illustrative examples and it should not be construed that the present invention is limited to these particular embodiments. Thus, various changes and modifications may be effected by one skilled in the art without departing from the spirit or scope of the invention as defined in the appended claims.

What is claimed is:

1. A method for performing a walk test for an alarm system having an alarm panel and at least one zone, each zone having at least one sensor, said method comprising the steps of:

operating the alarm panel in an engineering mode;

establishing a communications channel between the alarm panel and a communication device initiating limited remote control of the alarm panel;

setting the alarm panel in an appropriate state for the walk test, said setting is done using the communication device;

selecting one of the at least one zones;

triggering an alarm for each of the at least one sensors in the selected zone, and using the communications channel to report the triggering of the alarm to the communication device; and placing the alarm panel in the appropriate state for the walk test of a next zone after triggering all of the at least one sensors in the selected zone, wherein said step of placing is done using the communication device.

2. The method according to claim 1, further comprising the step of removing the alarm panel from the engineering mode and disconnecting the communications channel.

3. The method according to claim 1, wherein said communication device is one of a mobile telephone, a hand held computer, a personal digital assistant, and a portable personal computer.

4. The method according to claim 1, wherein the step of establishing further includes selecting the communications channel and the communications channel is one of plain old telephone systems, global system for mobile communications, general packet radio service, Ethernet with WIFI link, and radio frequency.

5. The method according to claim 1, wherein the communications channel is established by user input to the alarm panel.

6. The method according to claim 1, wherein the engineering mode comprises a walk test mode.

7. A computer readable storage medium storing a computer readable program for operating on a computer for performing a walk test for a security alarm system having an alarm panel and at least one zone, each zone having at least one sensor, said program comprising instructions that cause the computer to perform the steps of:

operating the alarm panel in an engineering mode;

establishing a communications channel between the alarm panel and a communication device initiating limited remote control of the alarm panel;

setting the alarm panel in an appropriate state for the walk test, said setting is done using the communication device;

selecting one of the at least one zones;

triggering an alarm for each of the at least one sensors in the selected zone, and using the communications channel to report the triggering of the alarm to the communication device; and placing the alarm panel in the appropriate state for the walk test of a next zone after triggering all of the at least one sensors in the selected zone, wherein said step of placing is done using the communication device.

8. The computer readable program according to claim 7, further comprising the step of removing the alarm panel from the engineering mode and disconnecting the communications channel.

9. The computer readable program according to claim 7, wherein said communication device is one of a mobile telephone, a hand held computer, a personal digital assistant, and a portable personal computer.

10. The computer readable program according to claim 7, wherein the step of establishing further includes selecting the communications channel and the communications channel is one of plain old telephone systems, global system for mobile communications, general packet radio service, Ethernet with WIFI link, and radio frequency.

11. The computer readable program according to claim 7, wherein the communications channel is established by user input to the alarm panel.

12. The computer readable program according to claim 7, wherein the engineering mode comprises a walk test mode.

13. A system for performing a walk test for a security alarm system, said system comprising:

an alarm panel operable in an engineering mode;

at least one zone, each zone having at least one sensor;

a communication device connected using a communications channel to the alarm panel;

wherein one of the at least one zones is selected and an alarm is triggered for each of the at least one sensors in the selected zone and the triggered alarm is reported to the communication device using the communications channel, and after all of the at least one sensors are triggered, the alarm panel is remotely placed in an appropriate state for the next walk test.

14. The system according to claim 13, wherein said communication device is one of a mobile telephone, a hand held computer, a personal digital assistant, and a portable personal computer.

15. The system according to claim 13, wherein the communications channel is one of plain old telephone systems, global system for mobile communications, general packet radio service, Ethernet with WIFI link, and radio frequency.

16. The system according to claim 13, wherein the alarm panel is removed from the engineering mode and the communications channel is disconnect in response to user input to the alarm panel.

17. The system according to claim 13, wherein the communications channel is established by user input to the alarm panel.

18. The system according to claim 13, wherein the engineering mode comprises a walk test mode.

* * * * *